US007494015B2

(12) United States Patent
Bacon et al.

(10) Patent No.: US 7,494,015 B2
(45) Date of Patent: Feb. 24, 2009

(54) CLEAR WINDOW PACKAGING ASSEMBLY AND METHOD

(76) Inventors: Thomas M. Bacon, 6434 NE. 38th St., Portland, OR (US) 97211; Raime Merriman, 4036 NE. 10th Ave., Portland, OR (US) 97212; Robert Blake Leftwich, 10017 NE. Shaver St., Portland, OR (US) 97220

( * ) Notice: Subject to any disclaimer, the term of this patent is extended or adjusted under 35 U.S.C. 154(b) by 233 days.

(21) Appl. No.: 11/389,247

(22) Filed: Mar. 27, 2006

(65) Prior Publication Data

US 2007/0193922 A1 Aug. 23, 2007

Related U.S. Application Data

(60) Provisional application No. 60/774,241, filed on Feb. 17, 2006.

(51) Int. Cl.
*B65D 25/54* (2006.01)
*B65D 85/30* (2006.01)

(52) U.S. Cl. ..... 206/778; 206/320; 206/589; 206/592

(58) Field of Classification Search ..... 206/305, 206/320, 326, 349–373, 461–471, 521, 525, 206/588–589, 591–592, 775–781
See application file for complete search history.

(56) References Cited

U.S. PATENT DOCUMENTS 2,993,587 A * 7/1961 Stone et al. ..... 206/471
3,670,881 A 6/1972 Dutcher
3,776,375 A * 12/1973 Rohdin ..... 206/470
4,180,165 A 12/1979 Kuchenbecker
4,739,353 A 4/1988 Heuer et al.
4,848,577 A * 7/1989 Hoffman et al. ..... 206/467
5,871,099 A * 2/1999 Mellenthin et al. ..... 206/781
5,979,662 A 11/1999 Green
6,039,495 A * 3/2000 Zimmerman et al. ..... 206/461
6,050,420 A 4/2000 Green
6,152,305 A 11/2000 Green (Continued)

FOREIGN PATENT DOCUMENTS

DE 80006903 3/1980

(Continued)

OTHER PUBLICATIONS

German Office Action with English Translation, Sep. 7, 2007.

*Primary Examiner*—Bryon P Gehman
(74) *Attorney, Agent, or Firm*—Paul, Hastings, Janofsky & Walker LLP

(57) ABSTRACT

The present disclosure provides a packaging assembly for containing and displaying a product. The packaging assembly includes an inner member that has a front face for displaying a product and one or several extension portions that extend from a back portion of the inner member toward the front. The assembly additionally includes an outer member that is configured to receive the inner member and has a window portion to expose the front face of the inner member. The outer member has one or several retention portions that extend inward from a front edge and engage the extension portions of the inner member in order to prevent removal of the inner member from the outer member through the window portion.

51 Claims, 5 Drawing Sheets

U.S. PATENT DOCUMENTS

| | | | | |
|---|---|---|---|---|
| 6,367,624 | B1 * | 4/2002 | Szczepanski et al. | 206/305 |
| 6,367,632 | B1 | 4/2002 | Green | |
| 6,427,842 | B1 | 8/2002 | Green | |
| 6,581,777 | B2 * | 6/2003 | Thibault | 206/780 |
| 2006/0113215 | A1 * | 6/2006 | Clements et al. | 206/779 |

FOREIGN PATENT DOCUMENTS

| | | |
|---|---|---|
| DE | 43 17 021 | 11/1994 |
| FR | 2 871 142 | 9/2005 |
| WO | WO 02/002420 | 10/2002 |

* cited by examiner

CLEAR WINDOW PACKAGING ASSEMBLY AND METHOD

This Application claims priority to U.S. Provisional Application No. 60/774,241 entitled Clear Window Packaging, filed Feb. 17, 2006.

BACKGROUND

1. Field of the Invention

The present invention relates to packaging assemblies and, more particularly, to packaging assemblies having a product display window and means to prevent removal of the product through the window.

2. Background of the Invention

Typically, warehouse shopping clubs, such as Costco and Sam's Club, require manufacturers to ship products according to very strict guidelines. These guidelines ensure that products are adequately protected during shipment, yet are convenient to handle on the warehouse floor and ready to display. To conform to the physical set-up of these warehouse clubs and to minimize their operational costs, the warehouse clubs prefer product packaging that enables a large number of product units to be placed at one time at the point-of-sale, with easy access to and viewing of the product. Typically, these clubs receive bulk products shipped and packaged on pallets. The clubs place the pallets directly on the sales floor.

In following these packaging guidelines, the challenge for the manufacturers is in striking the appropriate balance between adequately protecting the products from damage and minimizing the amount of handling necessary to display the products on the store floor. Further complicating this balance, the manufacturers generally favor plastic individual product packaging, such as clamshell packages or blister packs, because it is inexpensive and deters theft. Plastic packaging has the additional benefit of enabling the actual product to be viewable by consumers. Such packaging, however, is more susceptible to shipping damage and more difficult to display in bulk form (e.g., typical clamshells were originally intended to hang and will not stand up on their own). As a result, manufacturers and warehouse clubs are in a constant search for packaging that ships and protects the inexpensive plastic individual product packaging, and allows the easy handling and display of the products on the store floor.

A packaging assembly aimed at meeting the guidelines of warehouse clubs was described in U.S. Pat. Nos. 5,979,662; 6,050,420; 6,152,305; 6,367,632; and 6,427,842. This assembly has two distinguishing features. First, it requires that the plastic individual product packaging provide the support which allows multiple assemblies to be stacked on top of each other. Second, it relies on pairs of slots in the side panels of the base of the assembly alone to hold the plastic individual product packaging in place.

In order for the individual product packaging to provide support for the assembly, it must be strengthened beyond what is necessary to perform its primary functions of product protection, display, and theft deterrence. In order for the base of the assembly alone to hold the individual product packaging, it must also be strengthened beyond what is necessary to support and protect the assembly. Strengthening both the individual product packaging and the base of the assembly increases the overall cost and complexity of the packaging assembly. Accordingly, it can be appreciated that a substantial need exists for packaging assemblies that meet the guidelines of warehouse clubs and produce the lowest overall increase in packaging costs and complexity.

SUMMARY OF THE INVENTION

In accordance with an aspect of the present invention, a packaging assembly for containing a product is provided. The packaging assembly includes an inner member that has a body portion for containing the product, wherein at least part of the body portion is configured to reveal the product contained within, and an extension portion extending from the body portion. An outer member is further provided that is configured to receive the inner member. The outer member includes a window portion that is configured to reveal the body portion of the inner member when the inner member is placed within the outer member and a retention portion that is configured to engage the extension portion of the inner member, whereby the inner member is prohibited from being removable through the window portion of the outer member.

According to a further aspect of the present invention, a packaging assembly for containing a product is provided that includes an outer member that is substantially defined by a front side, a back side, a top side, a bottom side, a left side, and a right side. The outer member includes a window portion on the front side and at least one retention portion located on one or more of the top, bottom, left, and right sides, and configured to be foldable from the front side toward the back side. The packaging assembly further includes an inner member that is configured to be placed within the outer member and includes a see-through front surface that reveals at least part of the product contained within the inner member through the window portion of the outer member. The inner member further includes at least one extension portion that extends from the see-through front surface and is configured to be secured by the at least one retention portion of the outer member to prevent the inner member from being removable through the window portion of the outer member.

According to a further aspect of the present invention, a packaging assembly for containing a product includes a box that is substantially defined by a front side, a back side, a top side, a bottom side, a left side, and a right side. The box includes a window on the front side that extends to at least one of the top, bottom, left, and right sides. The box also includes a retention flap located on the at least one of the top, bottom, left, and right sides to which the window extends and the retention flap is configured to be foldable from the front side toward the back side so that it comes into contact with the at least one of the top, bottom, left, and right sides to which the window extends. The packaging assembly further includes a shell that is substantially defined by a front portion and a back portion. The shell includes a cavity defined by either the front portion, the back portion, or both, that contains the product and at least the front portion is made of a transparent or translucent material. The shell further includes an extension flap that extends from the front portion and is configured to be sandwiched between the retention flap of the box and the at least one of the top, bottom, left, and right sides of the box to which the window of the front side extends, so that the shell is not removable through the window of the box.

According to a further aspect of the present invention, a packaging assembly for containing a product includes an outer container having a base panel with a first edge, a second edge, a third edge opposite the first edge, and a fourth edge opposite the second edge. A first side panel has a lower end adjoining the first edge and an upper end. A first engagement member is attached to the upper end of the first side panel and extends toward the base panel. The outer container further includes a second side panel that has a lower end adjoining the second edge, a third side panel that has a lower end adjoining the third edge, and a fourth side panel that has a lower end adjoining the fourth edge. A window opening is defined in the outer container opposite the base panel. The packaging assembly further includes an inner container that contains the product and is viewable through the window opening. The inner container has a second engagement member disposed in between the first side panel and the first engagement member such that the inner container is prohibited from being removed through the window opening.

In accordance with another aspect of the present invention, a method for displaying a product is provided. In the method, a product is encased in an inner member and at least one side of the inner member is extended to include an extension flap. The inner member is inserted into an outer member having a window and the extension flap of the inner member engages with a retention portion of the outer member, whereby the inner member is prevented from being removed from the outer member via the window.

In accordance with a further aspect of the present invention, a method for displaying a product is provided in which an outer container is formed with four side panels extending from a base panel. A portion of at least one of the side panels is folded toward the base panel to form a retention flap. An inner container is formed to enclose the product and a portion of the inner container is folded toward a front surface of the inner container to form an extension flap. The retention flap of the outer container engages with the extension flap of the inner container so that the inner container is prevented from being removed from the outer container through an opening opposite the base panel.

In accordance with another aspect of the present invention, a method for displaying a product is provided. The method involves forming a shell having a front portion and a back portion to contain a product and extending an extension flap from the front portion of the shell. A box is formed having six sides and a window in a front side that extends to at least one other side, and a retention flap is extended from the at least one other side to which the window extends. The retention flap extends toward a side opposite the front side. The shell is inserted into the box, thereby preventing the removal of the shell through the window by sandwiching the extension flap between the retention flap and the side from which it extends.

Other objects, aspects, and advantages of the disclosure will become apparent from the following detailed description, the accompanying drawings, and the appended claims.

BRIEF DESCRIPTION OF THE DRAWINGS

The above-mentioned and other features and advantages of this disclosure, and the manner of attaining them, will become more apparent and the disclosure itself will be better understood by reference to the following description taken in conjunction with the accompanying drawings, wherein.

Figure 1:
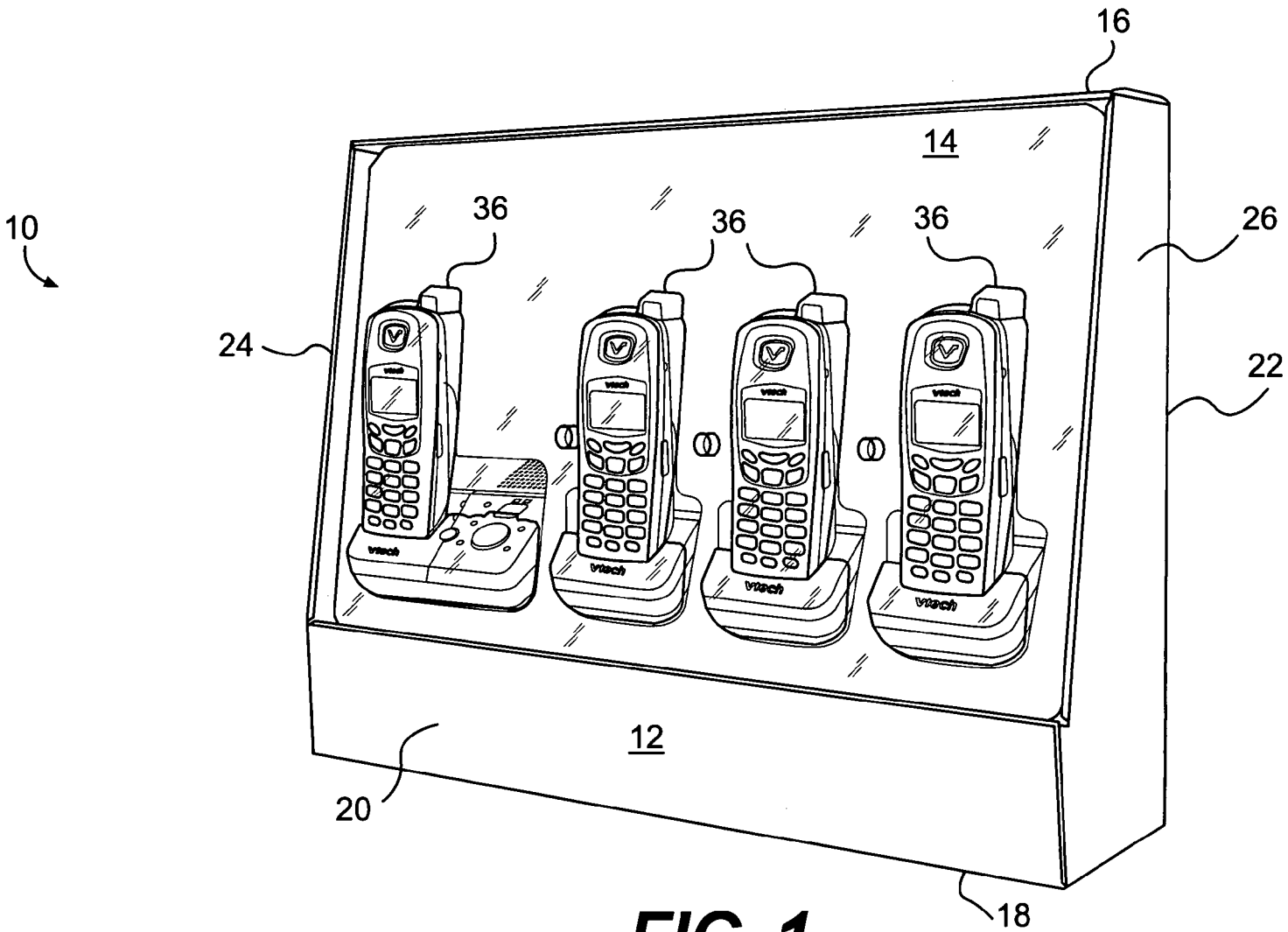
FIG. 1 is a perspective view of the packaging assembly in accordance with an embodiment of the present invention.

The invention will be described with reference to the accompanying drawings. Corresponding reference characters indicate corresponding parts throughout the several views. The description as set out herein illustrates an arrangement of an embodiment of the present invention and is not to be construed as limiting the scope of the disclosure in any manner.

DETAILED DESCRIPTION OF THE INVENTION

FIGS. 1-5 show the preferred embodiment of the present invention. As shown, the packaging assembly 10 in accordance with the present invention contains a product 36 and includes an inner member 14 and an outer member 12.

Figure 2:
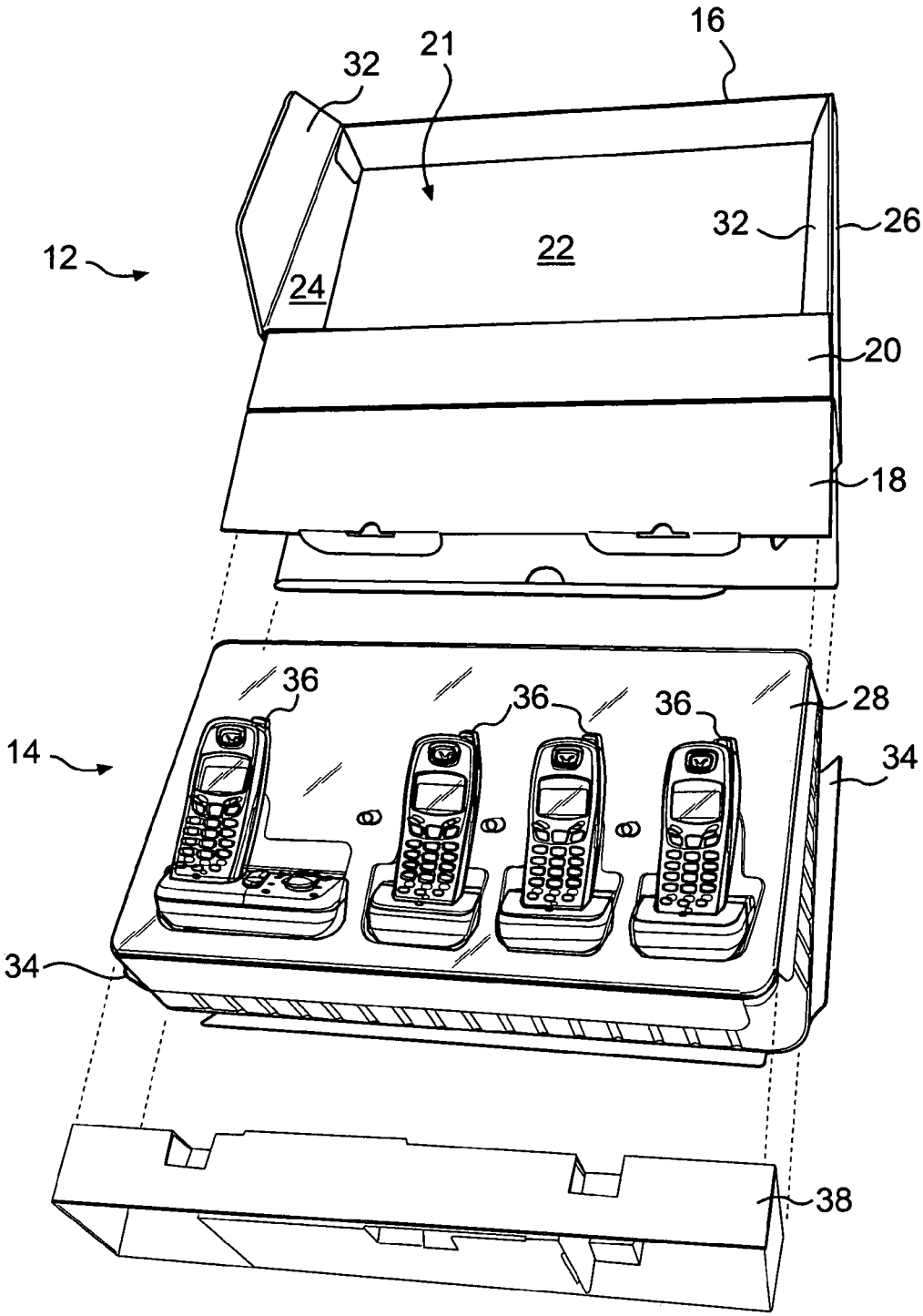
FIG. 2 is an exploded view of primary elements of the packaging assembly in accordance with an embodiment of the present invention.
Figure 3:
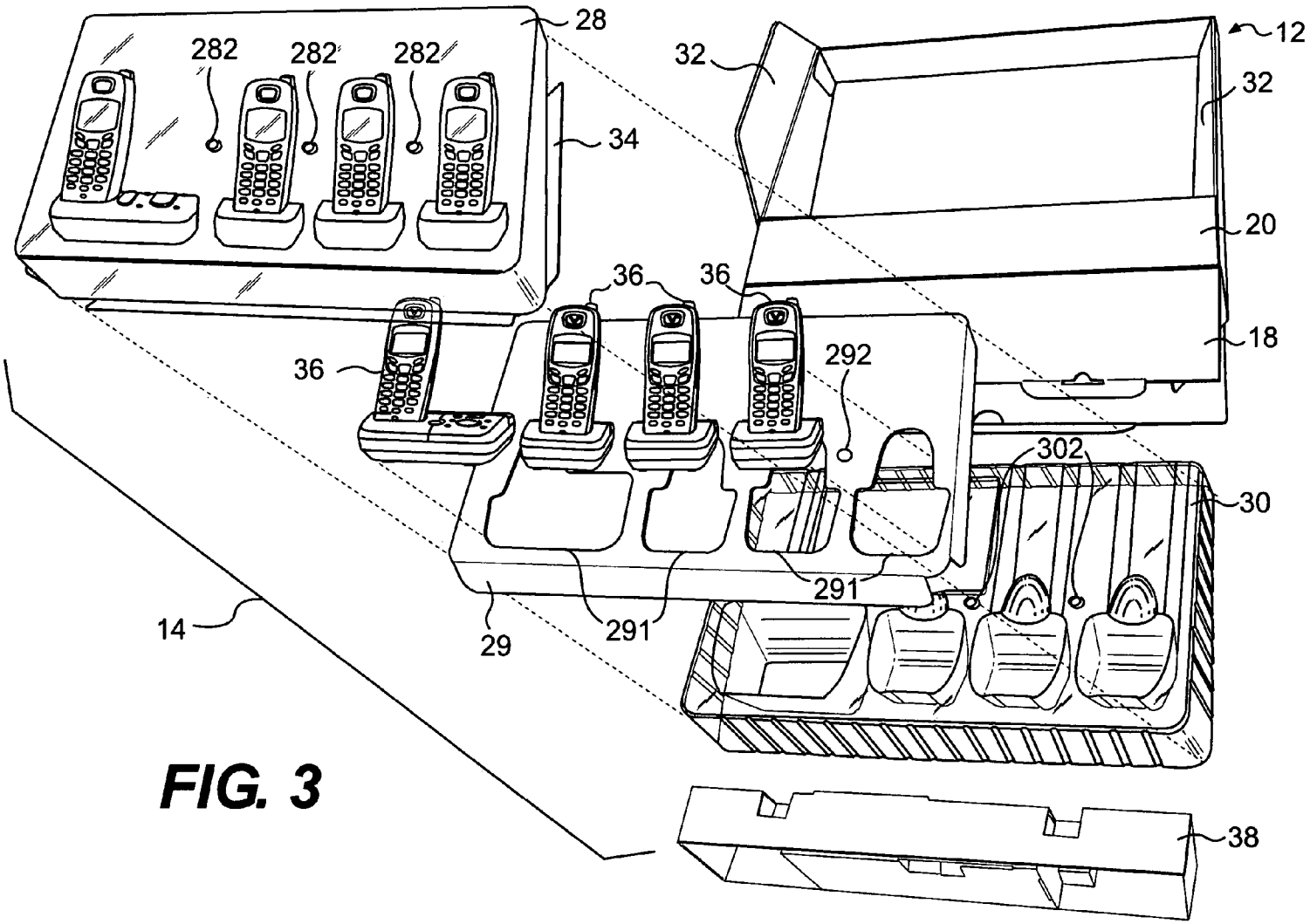
FIG. 3 is an exploded view of each of the elements of the packaging assembly in accordance with an embodiment of the present invention.

The inner member 14 includes a body portion, or shell, that contains the product 36 such that it is displayed through the packaging. The inner member 14 has a front portion 28 (see FIG. 2) that is made of a transparent or translucent plastic or other suitable material so that the product 36 is viewable. The inner member 14 has a back portion 30 that may be either transparent, translucent, or opaque. The two portions are configured to fit together so as to contain the product 36. A cavity or plurality of cavities may be defined by one or both of the front 28 and back 30 portions so that the product 36 is held and displayed securely. The inner member 14 may further include an intermediate insert 29 (see FIG. 3) to display product information or to otherwise enhance the display of the product 36. As shown in FIG. 3, intermediate insert 29 may include cutouts 291. Cutouts 291 are preferably shaped to accommodate the shape of the product 36. The intermediate insert 29 further acts to conceal the back portion 30 from viewing through a window portion 21, including any items located beneath the back portion 30 that may be visible.

The front 28 and back 30 portions may be sealed together by fusing the edges together. Alternatively, the two portions 28, 30 of the inner member 14 may fit together without a permanent seal and thus be completely separable. Each of the edges of the front 28 and back 30 may be sealed together to create a permanent and secure enclosure. The front 28 and back 30 portions may alternatively be provided with interlocking indents 282, 302 so that an interference fit is established between the two portions to hold them together and allow them to be separable. Holes 292 of the insert 29 are provided to facilitate engagement of indents 282, 302.

Figure 5:
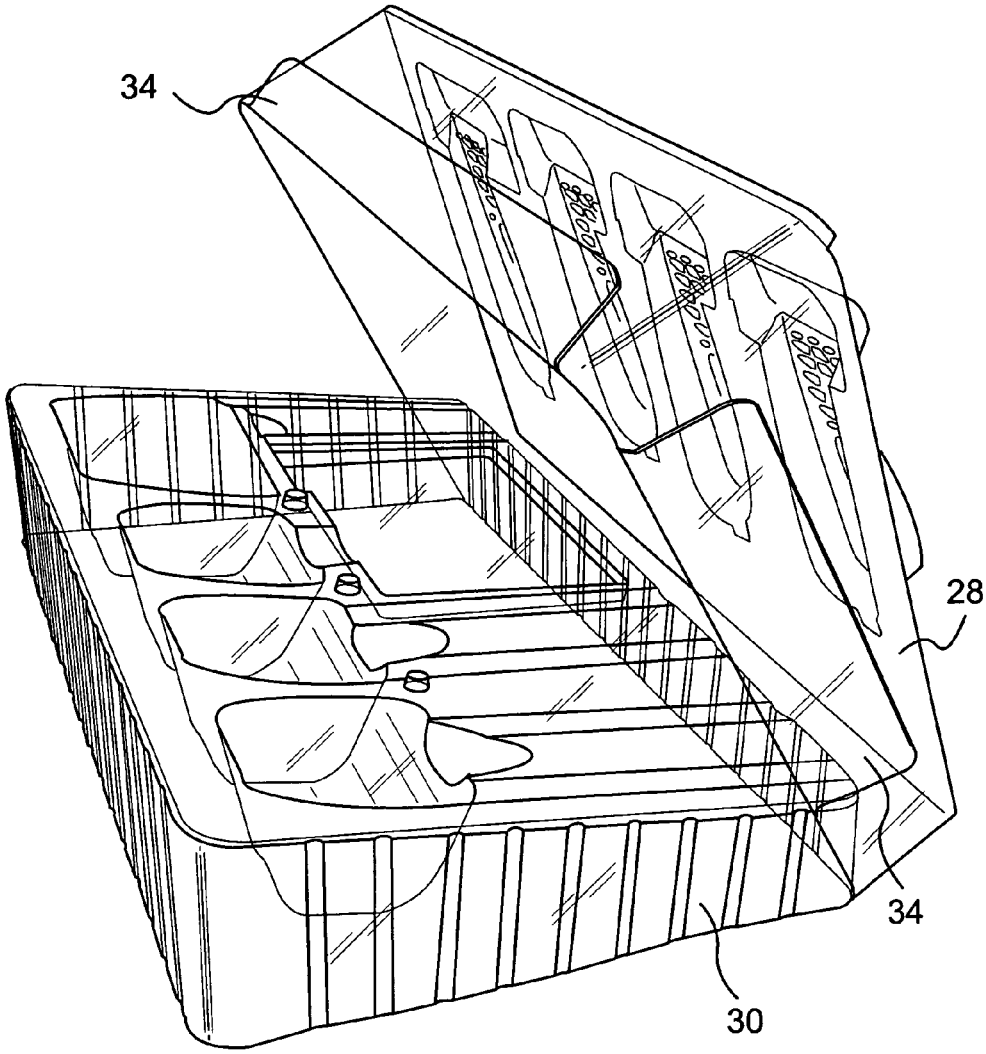
FIG. 5 is a perspective view of the inner member of the packaging assembly in accordance with an embodiment of the present invention.

When the front 28 and back 30 portions of the inner member 14 are fused together, the fused seal may be located along any one or several of the sides of the inner member 14. For example, the fused seal may be located along one side, such as the top side, as shown in FIG. 5. In this manner, when the inner member 14 is removed from the outer member 12, the inner member 14 acts like a clamshell and the front portion 28 may pivot about the fused seal at the top edge to provide access to the product 36. The fused seal may be located on any side or sides of the inner member 14. Alternatively, the fused seal may join the front 28 and back 30 portions of the inner member 14 on all sides. This arrangement may provide the benefit of more securely containing the product 36.

The inner member 14 includes an extension portion 34 (see FIG. 2), or flap, on one or several sides in order to further secure the packaging assembly 10 by engaging with the outer member 12, as discussed below. The extension portion 34 may be located on one or both of the front 28 and back 30 portions of the inner member 14. Preferably, when the front 28 and back 30 portions are not permanently sealed, the front portion 28 has the extension portions 34. When the front 28 and back 30 portions are permanently sealed, for example by fusing the edges of the portions together, then either the front 28 or back 30 portions may have the extension portions 34. The extension portions 34 may be attached to the inner member 14 at a back edge and fold forward toward the displayed face or front of the inner member 14.

The packaging assembly 10 in accordance with the present invention further includes an outer member 12. The outer member 12 is generally box-shaped and may be made of corrugated cardboard or another suitable material having a high strength-to-weight ratio. The outer member 12 may have six panels: top 16, bottom 18, front 20, back 22 (sometimes referred to herein as the "base panel"), left 24, and right 26, and includes a window portion 21 on a front side so that the inner member 14 is visible through the window portion 21 when the packaging assembly 10 is assembled. Thus, the front panel 20 may be of reduced size so as to allow a window portion 21. The window 21 would therefore extend to, for example, the top 16, left 24, and right 26 panels and to the top edge of the front panel 20.

Figure 4:
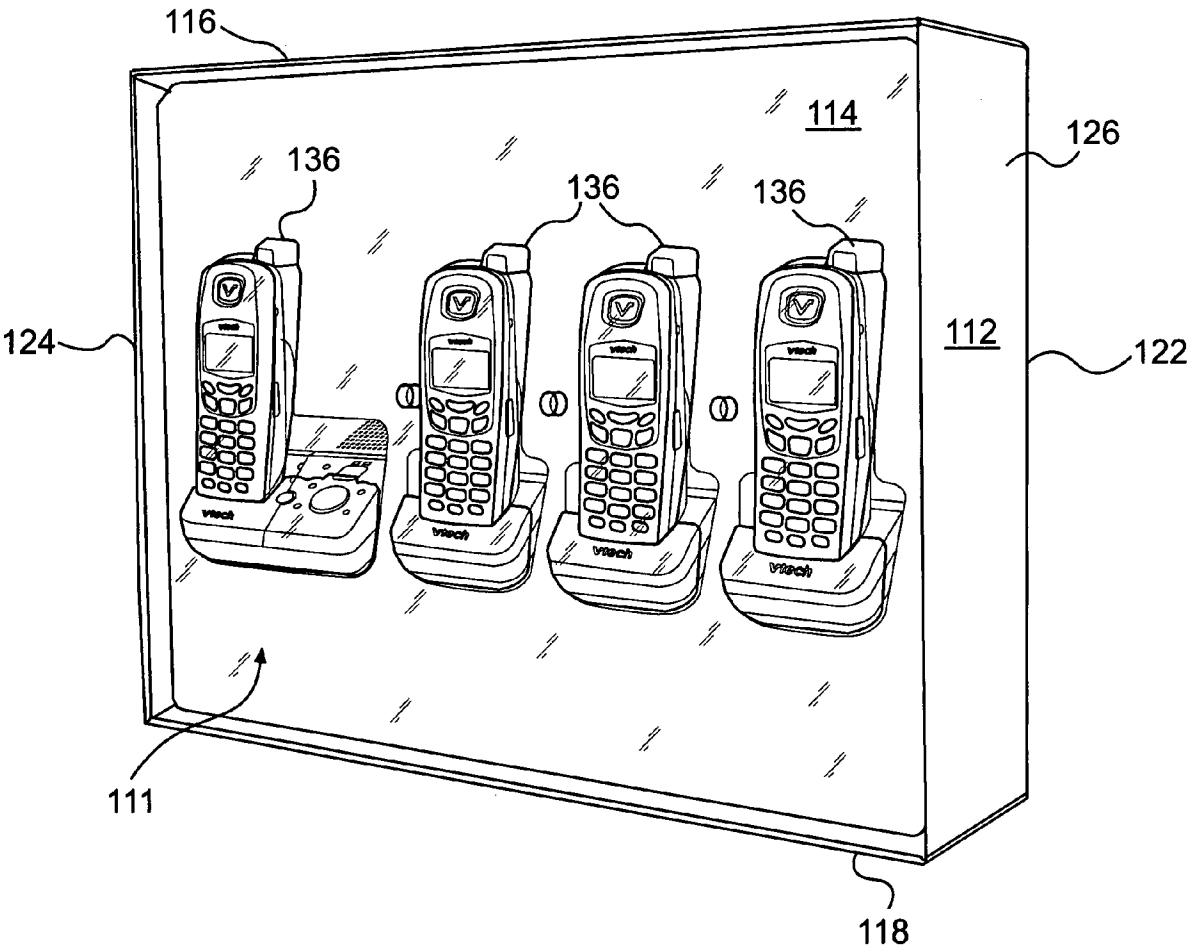
FIG. 4 is a perspective view of the packaging assembly in accordance with another embodiment of the present invention.

The outer member may alternatively have five or fewer panels. FIG. 4 shows another embodiment of the packaging assembly that includes an outer member 112 having a five-panel configuration in which there is no front panel. The outer member 112 resembles a tray and has a top panel 116, bottom panel 118, back panel 122, left panel 124, and right panel 126. In this embodiment, the entire frontal face of an inner portion 114 is visible through the window portion 111 of the outer member 112. Thus, the window 111 extends to each of the top 116, bottom 118, left 124, and right 126 panels.

The side panels of the outer member 12, 112 may be tapered so as to enhance visibility of the inner member 14, 114 through the window portion 21, 111, or they may be of constant width. FIGS. 1-3 depict the side panels 24, 26 being tapered and FIG. 4 depicts side panels 124, 126 having constant width. Although not shown, one of skill in the art would recognize that the six-panel outer member 12 shown in FIGS. 1-3 may alternatively have side panels 24, 26 with a constant width, and that the five-panel outer member 112 shown in FIG. 4 may alternatively have side panels 124, 126 being tapered. In embodiments having tapered side panels, such as that shown in FIGS. 1-3, the width at the top of the left 24 and right 26 side panels may be smaller than the width at the bottom of the respective panels, and the surface area of the bottom panel 18 is therefore larger than the surface area of the top panel 16.

Bottom panel 18 has a surface area large enough so that the packaging assembly 10 stands on its own while being transported or displayed and supports weight placed on the top of the assembly. When sold in warehouse shopping clubs, the product is typically both transported and displayed on a pallet. The packaging assemblies 10 may be packed on a pallet by providing a first level of packaging assemblies 10 standing on their own on bottom panel 18. A tray or other flat layer suitable as a level divider may then be placed on the tops of the first level of packaging assemblies 10 so as to provide a flat surface for supporting the next level of packaging assemblies 10. The pallet may be wrapped in shrink wrap or otherwise contained during shipment and is then unwrapped and displayed for sale in, e.g., a warehouse shopping club. As consumers remove the packaging assemblies 10 from the pallet, each level divider may be successively removed so that the next level of packaging assemblies is displayed. The construction of the outer member 12 in accordance with the present invention provides sufficient supporting strength to support pallet packing and displaying in this way by virtue of the bottom panel 18 having a large surface area. The top panel 16 may be of reduced surface area in order to enhance the display of the product 36 or the top panel 16 may have the same surface area as the bottom panel.

To prevent the inner member 14 from being removed from the outer member 12 through the front window portion 21, the outer member 12 includes retention portions, or flaps, 32 that engage with the extension portion, or flap, 34 located on the inner member 14. In the embodiment shown in FIG. 2, the outer member 12 includes two retention portions 32, one extending from the left side panel 24 and one extending from the right side panel 26. The retention portion 32 shown extending from the left panel 24 is bent upward for purposes of clarity; in use, the retention portions 32 may extend from the side panels 24, 26 and fold inward and toward the back panel, as shown by the retention flap 32 extending from the right panel 26. When the inner member 14 is not within the outer member 12, the retention portions 32 in their folded configuration may come into contact with the panel from which they extend. The outer member 12 may include one or several retention flaps 32 extending from any one or several of the top 16, bottom 18, left 24, or right 26 panels.

In the preferred embodiment shown in the Figures, left 24 and right 26 side panels have retention flaps 32 located thereon. The retention flaps 32 are attached along the front edge of the side panels 24, 26, and folded inward into the outer member and toward the back panel 22, as described above. Accordingly, the inner member 14 may be slid into the outer member 12 by opening the bottom panel 18 (or top panel 16). When the inner member 14 is inserted into the outer member 12, extension portions 34 slide within the fold created by retention portions 32 and are sandwiched between the retention portion 32 and the inside of the panel 24 or 26, thereby preventing the removal of the inner member 14 in the forward direction through the window portion 21.

Alternatively, the top 16 and bottom 18 panels may have the retention flaps 32. In that case, the inner member 14 may be slid into the outer member from the side by opening either the left 24 or right 26 side panel to permit access.

In a further embodiment, the inner member 14 is inserted into the outer member 12 through an opening provided in the back panel 22 of the outer member 12. One, two, three, or all of the top 16, bottom 18, left 24, and right 26 panels may have a retention portion 32 thereon, and one, two, three, or all of the corresponding top, bottom, left, and right sides of the inner member 14 may have extension portions 34 thereon. In this embodiment, increased security may be provided by as many as four pairs of engaging retention 32 and extension 34 portions to prevent the removal of the inner member 14 from the outer member 12 through the front window opening 21.

As shown in FIG. 2, the packaging assembly 10 may further provide for the inclusion of a product insert 38. The product insert 38 may contain additional parts, accessories, or informational materials related to the product 36 that are not necessary to be displayed through the front window portion 21. For example, user manuals, attachment and extension cords, and other accessories may be kept in product insert 38. As shown in the Figures, the length from the top to the bottom of the inner member 14 may be configured to be smaller than the length from the top to the bottom of the outer member 12. This may be done so that once the inner member 14 is inserted into the outer member 12 there will exist some space within the outer member 12 just below the bottom surface of the inner member 14. The product insert 38 may be sized and shaped to fit within that space so that all necessary parts and information for the product are contained within the packaging assembly 10. The product insert 38 may have cutouts or body angles so as to maximize its containment space while accommodating the shape of the inner member 14 and the product 36 contained thereby.

The inner member 14 may also be configured so that the product insert 38 is positioned between the front portion 28 and the back portion 30. In such a configuration, if the front portion 28 and back portion 30 of the inner member 14 are fused, sealed, or otherwise held together, the product insert 38 may be sealed therein as well so that all of the product materials are contained within the inner member 14.

The product insert 38 may also be configured to fit underneath the back portion 30 of the inner member 14. In this case, the product insert 38 may be placed underneath the back portion 30 in a space provided therein (e.g., by molding the back portion to allow such space) prior to the inner member 14 being inserted into the outer member 12. In this case, the intermediate insert 29 may be utilized to conceal the product insert 38 from view through the window portion 21.

While specific embodiments have been described above, it will be appreciated that the subject of the present disclosure may be practiced otherwise than as described. The descriptions above are intended to be illustrative, not limiting. Thus, it will be apparent to one skilled in the art that modifications may be made without departing from the scope of the claims set out below.

What is claimed is:

1. A packaging assembly for containing a product, comprising:

an inner member, comprising:

a body portion for containing the product, wherein at least part of the body portion is configured to reveal the product contained within, the body portion comprising a front portion and a back portion;

an extension portion extending from only the front portion of the body portion; and an outer member configured to receive the inner member, comprising:

a window portion configured to reveal the body portion of the inner member when the inner member is placed within the outer member, a retention portion extending toward an interior space of the outer member and being configured to engage the extension portion of the inner member, wherein the inner member is prohibited from being removable through the window portion of the outer member by virtue of the retention portion retaining the extension portion on the front portion of the inner member, and the back portion of the inner member is retained in position by virtue of being held between the retained front portion and a back surface of the outer member.

2. The packaging assembly of claim 1, wherein the front and back portions are separable to facilitate placement of the product within the body portion.

3. The packaging assembly of claim 2, wherein one or both of the front and back portions is made of a transparent or translucent material.

4. The packaging assembly of claim 2, wherein at least one edge of each of the front and back portions are fused together.

5. The packaging assembly of claim 1, wherein the outer member comprises a front side, a back side, a top side, a bottom side, a left side, and a right side.

6. The packaging assembly of claim 5, wherein the window portion is part of the front side.

7. The packaging assembly of claim 5, wherein the retention portion is located on one or more of the left, right, top and bottom sides.

8. The packaging assembly of claim 7, wherein the extension portion of the inner member extends in a direction from the back side towards the front side, and the retention portion of the outer member extends in the opposition direction from the front side towards the back side.

9. The packaging assembly of claim 5, wherein the bottom side is larger than the top side.

10. A packaging assembly for containing a product, comprising:

an outer member substantially defined by a front side, a back side, a top side, a bottom side, a left side, and a right side, the outer member comprising:

a window portion on the front side, at least one retention portion located on one or more of the top, bottom, left, and right sides, wherein the at least one retention portion extends substantially completely from the front side to the back side and is configured to be foldable from the front side towards the back side; and an inner member configured to be placed within the outer member, comprising:

a see-through front surface configured to reveal at least part of a product contained within the inner member through the window portion of the outer member, a back surface shaped to conform to the front surface and to a product received therein;

at least one extension portion extending only from the see-through front surface, the at least one extension portion is configured to be secured by the at least one retention portion of the outer member to prevent the inner member from being removed through the window portion of the outer member, wherein the back surface is secured solely by virtue of being held between the secured see-through front surface and the back side of the outer member.

11. The packaging assembly of claim 10, wherein a surface area of the bottom side is larger than a surface area of the top side.

12. The packaging assembly of claim 10, wherein the bottom side is configured to receive the inner member, and the at least one retention portion is located on one or more of the top, left, and right sides.

13. The packaging assembly of claim 10, wherein the back side is configured to receive the inner member, and the at least one retention portion is located on one or more of the top, bottom, left, and right sides.

14. The packaging assembly of claim 10, wherein the window portion occupies substantially the entire front side of the outer member.

15. The packaging assembly of claim 14, wherein the inner member includes at least two extension portions and the outer member includes at least two corresponding retention portions.

16. The packaging assembly of claim 15, wherein the at least two retention portions are located along the left and right sides.

17. The packaging assembly of claim 15, wherein the at least two retention portions are located along the top and bottom sides.

18. The packaging assembly of claim 10, wherein the window portion extends to one to three of the top, bottom, left, and right sides of the outer member.

19. The packaging assembly of claim 18, wherein the at least one retention portion is located along one or more of the top, bottom, left and right sides of the outer member to which the window portion is extended.

20. A packaging assembly for containing a product comprising:

a box substantially defined by a front side, a back side, a top side, a bottom side, a left side, and a right side, the box comprising:

a window on the front side, wherein the window extends to at least one of the top, bottom, left, and right sides, a retention flap located on the at least one of the top, bottom, left, and right sides to which the window is extended, wherein the retention flap extends substantially completely from the front side to the back side and is configured to be foldable from the front side toward the back side so that the retention flap comes into contact with the at least one of the top, bottom, left, and right sides to which the window is extended; and a shell substantially defined by a front portion and a back portion, the shell comprising:

a cavity defined by at least one of the front and back portions for containing the product, wherein at least the front portion of the shell is made of a transparent or translucent material, an extension flap extending only from the front portion, wherein the extension flap is configured to be sandwiched between the retention flap of the box and the at least one of the top, bottom, left, and right sides of the box to which the window of the front side is extended, wherein the shell is not removable through the window of the box and the back portion is retained in position by virtue of being held between the front portion of the shell and the back side of the box.

21. The packaging assembly of claim 20, further comprising an intermediate insert located between the front portion and the back portion of the shell.

22. The packaging assembly of claim 21, wherein the intermediate insert comprises one or more cutouts to accommodate a shape of the product.

23. The packaging assembly of claim 22, further comprising indents formed on each of the front portion and the back portion of the shell configured to interlock the front portion to the back portion, the intermediate insert further comprising holes to accommodate the passage of indents through the intermediate insert.

24. The packaging assembly of claim 21, wherein the intermediate insert comprises information associated with the product.

25. The packaging assembly of claim 21, wherein there are one to three retention flaps for the box, and the retention flaps are located along the top, left, and right sides of the box.

26. The packaging assembly of claim 25, wherein there are one to three extension flaps for the shell, the extension flaps are configured to engage the one to three retention flaps for the box.

27. The packaging assembly of claim 20, wherein the front portion and the back portion of the shell comprise corresponding interlocking indents.

28. The packaging assembly of claim 20, wherein the front portion and the back portion are completely separable.

29. The packaging assembly of claim 20, wherein the front portion and the back portion are fused along only one of their corresponding edges.

30. The packaging assembly of claim 20, wherein the window on the front side of the box extends to at the top, left, and right sides of the box.

31. A packaging assembly for containing a product comprising:

an outer container having a base panel, the base panel having a first edge, a second edge, a third edge opposite the first edge, and a fourth edge opposite the second edge, a first side panel having a lower end adjoining the first edge and an upper end, a first engagement member attached to the upper end of the first side panel and extending substantially the entire distance toward the base panel, a second side panel having a lower end adjoining the second edge, a third side panel having a lower end adjoining the third edge, and a fourth side panel having a lower end adjoining the fourth edge, the outer container defining a window opening opposite the base panel; and an inner container containing the product, the inner container viewable through the window opening, and the inner container having a second engagement member on a front portion of the inner container disposed in between the first side panel and the first engagement member such that the inner container is prohibited from being removed through the window opening, the inner container further comprising a back portion that is retained in position within the outer container by virtue of the first engagement member engaging with the second engagement member on the front portion and the base panel of the outer container.

32. The packaging assembly of claim 31, the first and second engagement members slideably engaging each other in a direction generally parallel to a plane defined by the window opening.

33. The packaging assembly of claim 31, the inner container having a first face disposed at the window opening and a second face opposite the first face and disposed at the base panel, the second engagement member extending in a direction from the second face to the first face.

34. The packaging assembly of claim 31, the upper ends of the first, second, third, and fourth side panels defining the window opening.

35. The packaging assembly of claim 31, the outer container further comprising a front panel adjoining the first, third, and fourth side panels, wherein the first side panel, the second side panel, the third side panel, and the front panel define the window opening.

36. The packaging assembly of claim 31, the third side panel having an upper end opposite its lower end, a third engagement member aft ached to the upper end of the third side panel and extending toward the base panel, and the inner container having a fourth engagement member disposed in between the third side panel and the third engagement member.

37. A method for displaying a product, comprising:

encasing a product in an inner member having a front portion and a back portion;

aligning the front portion and the back portion by a plurality of interlocking indents located on each of the front portion and the back portion;

extending at least one side of the front portion of the inner member to include an extension flap;

inserting the inner member into an outer member having a window by sliding the inner member into an open panel of the outer member; and engaging, by aligning the extension flap of the inner member with a retention portion of the outer member during the sliding movement of the inner member relative to the outer member, the retention portion of the outer member extending substantially the entire distance from a front side of the outer member to a back side of the outer member, whereby the inner member is prevented from being removed from the outer member, via the window, as a result of the extension flap of the inner member being sandwiched between a side panel of the outer member and the retention portion of the outer member, with each of the extension flap, the retention portion, and the side panel of the outer member defining substantially planar surfaces, all being substantially parallel to each other in the sandwiched position, and substantially perpendicular to a plane defined by the window of the outer member, and wherein the back portion of the inner member is retained in position by virtue of being held between the retained extension flap of the front portion and a back panel of the outer member.

38. The method of claim 37, wherein the inner member has a plurality of extension flaps that engage with a plurality of retention portions in the outer member.

39. The method of claim 38, wherein the inner member has extension flaps on two opposite sides and the outer member has retention portions on two corresponding opposite sides, the extension flaps engaging the retention portions by sliding the inner member into the outer member.

40. The method of claim 38, wherein the inner member has four sides having extension flaps extending therefrom, the outer member has four sides having retention portions extending therefrom, the extension flaps engaging the retention portions by inserting the inner member into the outer member through a fifth side of the outer member.

41. The method of claim 37, further comprising displaying the product through a transparent or translucent portion of the inner member and through the window of the outer member.

42. The method of claim 37, the encasing step comprising fusing at least one edge of the front portion to at least one edge of the back portion.

43. The method of claim 37, further comprising interlocking the front portion and the back portion of the inner member by means of corresponding indents; and inserting an intermediate layer between the front portion and the back portion, the intermediate layer having holes to accommodate the passage of the indents.

44. A method for displaying a product, comprising:

forming an outer container having four panels extending from a base panel;

folding a portion of at least one of the panels toward the base panel to form a retention flap, the retention flap extending substantially the entire distance toward the base panel;

forming an inner container to enclose the product, the inner container having a front portion and a back portion, the front portion having side panels that extend from a front side of the inner container to a back side of the inner container, the back portion fitting within the front portion;

folding a portion of the inner container toward a front surface of the inner container to form an extension flap, the extension flap being formed on a side panel of the front portion and folded to extend from a back side to a front side; and engaging the retention flap of the outer container with the extension flap of the inner container so that the front portion of the inner container is prevented from being removed from the outer container through an opening opposite the base panel while the back portion of the inner container is retained in position by virtue of being held between the front portion and a back surface of the outer container and does not engage with any retention flaps of the outer container.

45. The method of claim 44, wherein portions of two panels of the outer container are folded toward the base panel to form two retention flaps and two portions of the inner container are folded toward the front surface of the inner container to form two extension flaps, the method further comprising inserting the inner container into the outer container by opening one of the panels of the outer container and sliding the inner container into the outer container.

46. The method of claim 45, wherein four retention flaps and four extension flaps are formed, the retention flaps and extension flaps engaging each other by inserting the inner container into the outer container by opening the base panel.

47. The method of claim 44, further comprising displaying the product though a transparent or translucent portion of the inner container.

48. A method for displaying a product, comprising:

forming a shell having a front portion and a back portion to contain a product;

extending an extension flap from only the front portion of the shell;

forming a box having six sides and a window in a front side that extends to at least one other side, one of the six sides being a back side, opposite the front side, that is opaque;

extending a retention flap from the at least one other side to which the window extends, the retention flap extending substantially the entire distance toward the back side;

inserting the shell into the box; and preventing the removal of the shell though the window by sandwiching the extension flap between the retention flap and the side from which it extends, with each of the extension flap and the retention flap defining substantially planar surfaces that are substantially parallel to each other in the sandwiched position and are substantially perpendicular to a plane defined by the window of the box, wherein the back portion of the shell is retained in position by virtue of being held between the retained extension flap of the front portion and the back side of the box.

49. The method of claim 48, further comprising displaying the product through a transparent or translucent portion of the shell.

50. The method of claim 48, wherein two extension flaps are extended from the shell, wherein the window in the front side extends to two other sides of the box, and wherein two retention flaps are extended from each of the other sides to which the window extends, the inserting step comprising sliding the shell into the box through an opening in a side between the sides to which the window extends.

51. The method of claim 48, wherein four extension flaps are extended from the shell, wherein the window extends to four sides of the box, and wherein four retention flaps are extended from each of the four sides to which the window extends, the inserting step comprising inserting the shell into the box through an opening in the side opposite the window.

* * * * *